US009534545B2

(12) United States Patent
Ko

(10) Patent No.: US 9,534,545 B2
(45) Date of Patent: Jan. 3, 2017

(54) METHOD FOR PROTECTING ENGINE FROM SHORT CIRCUITING AND WIRE FAILURE OF FAN CLUTCH, AND DEVICE THEREOF

(75) Inventor: Jin-Woo Ko, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 108 days.

(21) Appl. No.: 14/427,122

(22) PCT Filed: Sep. 14, 2012

(86) PCT No.: PCT/KR2012/007381

§ 371 (c)(1),
(2), (4) Date: Mar. 10, 2015

(87) PCT Pub. No.: WO2014/042300

PCT Pub. Date: Mar. 20, 2014

(65) Prior Publication Data

US 2015/0226136 A1 Aug. 13, 2015

(51) Int. Cl.

| | |
|---|---|
| ***F02D 31/00*** | (2006.01) |
| ***F01P 5/14*** | (2006.01) |
| ***F01P 11/16*** | (2006.01) |

(52) U.S. Cl.

CPC ..... *F02D 31/001* (2013.01); *F01P 5/14* (2013.01); *F01P 11/16* (2013.01); *F01P 2031/00* (2013.01); *F01P 2031/34* (2013.01)

(58) Field of Classification Search

CPC ..... F02D 31/001–31/009; F01P 5/14; F01P 2031/00; F01P 2031/34; F01P 11/16; F01P 7/04

(Continued)

(56) References Cited

U.S. PATENT DOCUMENTS 4,102,316 A 7/1978 Valbert
4,336,778 A * 6/1982 Howard ..... B60K 28/00 123/198 D (Continued)

FOREIGN PATENT DOCUMENTS

KR 10-1998-0030212 A 7/1998
KR 10-1999-0004084 A 1/1999

(Continued)

OTHER PUBLICATIONS

Examination Report Under Section 18(3) issued by the UK Intellectual Property Office (UK-IPO) on May 19, 2016 for corresponding GB Application No. 1503725.2 (4 pages).

(Continued)

*Primary Examiner* — Lindsay Low
*Assistant Examiner* — Robert Werner
(74) *Attorney, Agent, or Firm* — Harness, Dickey & Pierce, P.L.C.

(57) ABSTRACT

The present invention relates to a method for protecting an engine from short circuiting and wire failure of a fan clutch, and a device thereof wherein the method for protecting an engine comprises: a step of sensing the temperature of a coolant if a fan rotates at a set minimum rpm by the short circuiting and wire failure of a fan clutch; a step of comparing the sensed coolant temperature and a set danger temperature; and a step of defaulting if the sensed coolant temperature is lower than the set danger temperature and reducing the engine rpm if the sensed coolant temperature is equal to or higher than the set danger temperature according to a result of the comparison such that overheating of the engine can be prevented. The engine rpm is gradually lowered so as to protect the engine at a first stage if the fan operates at the minimum rpm due to the cable short cut and failure of the fan clutch, and the engine is forcedly stopped (Continued)

so as to protect the engine at a second stage if the overheating of the coolant is serious, thereby ensuring durability of the engine.

14 Claims, 3 Drawing Sheets

(58) Field of Classification Search
USPC ..... 701/110; 123/395–396, 198 D, 41.05, 123/41.11, 41.12, 41.48, 41.49
See application file for complete search history.

(56) References Cited

U.S. PATENT DOCUMENTS

| | | | |
|---|---|---|---|
| 4,453,512 | A | 6/1984 | Sakae et al. |
| 4,695,822 | A | 9/1987 | Furukawa |

FOREIGN PATENT DOCUMENTS

| | | | |
|---|---|---|---|
| KR | 10-1999-0057236 | A | 7/1999 |
| KR | 10-2004-0052422 | A | 6/2004 |

OTHER PUBLICATIONS

International Search Report (in Korean and English) and Written Opinion (in Korean) for PCT/KR2012/007381, mailed Dec. 26, 2012; ISA/KR.

* cited by examiner

METHOD FOR PROTECTING ENGINE FROM SHORT CIRCUITING AND WIRE FAILURE OF FAN CLUTCH, AND DEVICE THEREOF

CROSS-REFERENCE TO RELATED APPLICATION

This application is a 371 U.S. National Stage of International Application No. PCT/KR2012/007381, filed on Sep. 14, 2012. The entire disclosure of the above application is hereby incorporated by reference.

TECHNICAL FIELD

The present invention relates to a method and device for protecting an engine from a wiring short-circuit and failure of a fan clutch. More particularly, the present invention relates to such a method and device for protecting an engine from a wiring short-circuit and failure of a fan clutch, in which when a cooling fan is rotated at a minimum rpm due to the wiring short-circuit and failure of a fan clutch, the RPM of the engine can be stepwise reduced depending on the temperature of a cooling water to protect the engine, and in which when the cooling water is severely overheated, the engine can be compulsorily stopped to protect the engine.

BACKGROUND OF THE INVENTION

As shown in FIG. 1, a fan clutch is generally configured such that a cooling fan is driven by a drive method according to a hardware structure of the fan clutch when a wiring of the fan clutch is short-circuited.

However, this type fan clutch entails a problem in that when the wiring of the fan clutch is short-circuited to cause the cooling fan to be rotated at a minimum RPM, the temperature of a cooling water rises sharply in an engine cooling system in response to the rotation of the cooling fan, thereby causing a great damage to the engine.

SUMMARY OF THE INVENTION

Accordingly, the present invention has been made to solve the aforementioned problems occurring in the prior art, and it is an object of the present invention to provide a method and device for protecting an engine from a wiring short-circuit and failure of a fan clutch, in which when a cooling fan is rotated at a minimum rpm due to the wiring short-circuit and failure of a fan clutch, the RPM of the engine can be stepwise reduced depending on the temperature of a cooling water to protect the engine, and in which when the cooling water is severely overheated, the engine can be compulsorily stopped to protect the engine.

TECHNICAL SOLUTION

To achieve the above object, in accordance with an embodiment of the present invention, there is provided a method for protecting an engine from a wiring short-circuit and failure of a fan clutch in a system configured to drive a cooling fan at a preset minimum RPM when the wiring short-circuit and failure of the fan clutch occurs, the method including the steps of:

detecting a temperature of a cooling water if the cooling fan is rotated at the preset minimum RPM due to the wiring short-circuit and failure of the fan clutch;

comparing the detected cooling water temperature with a preset dangerous temperature; and defaulting an engine RPM if the detected cooling water temperature is lower than the preset dangerous temperature as a result of the comparison and reducing the engine RPM if the detected cooling water temperature is equal to or higher than the preset dangerous temperature.

In accordance with a preferred embodiment of the present invention, the step of reducing the engine RPM may include setting the preset dangerous temperature and the step of reducing the engine RPM to be multiple temperatures and steps, respectively, and setting information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures.

In addition, the method may further include compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

Preferably, the method may further include turning on a warning light or outputting an alarm sound, or displaying a message on a dashboard if the detected cooling water temperature is equal to or higher than the preset dangerous temperature.

In addition, the method may further include counting a predetermined time if the cooling fan is rotated at the preset minimum RPM due to the wiring short-circuit and failure of the fan clutch, and reducing the engine RPM regardless of the temperature of the cooling water to prevent the engine from being overheated if the counted predetermined time exceeds a preset dangerous time.

Preferably, the step of reducing the engine may include setting the preset dangerous time and the step of reducing the engine RPM to multiple times and steps, respectively, and setting information on the engine RPM which it is desired to reduce according to each of the set multiple steps so as to reduce the engine RPM by the set RPM of a corresponding step matched whenever the counted predetermined time exceeds each of the set multiple dangerous times.

To achieve the above object, in accordance with another embodiment of the present invention, there is provided an apparatus for protecting an engine from a wiring short-circuit and failure of a fan clutch, the apparatus including:

a cooling water temperature detection unit for detecting a temperature of a cooling water if the cooling fan is rotated at the preset minimum RPM due to the wiring short-circuit and failure of the fan clutch;

a temperature comparison unit for comparing the detected cooling water temperature with a preset dangerous temperature; and a first engine overheating prevention unit for defaulting an engine RPM if the detected cooling water temperature is lower than the preset dangerous temperature as a result of the comparison and reducing the engine RPM to prevent the engine from being overheated if the detected cooling water temperature is equal to or higher than the preset dangerous temperature.

Preferably, the first engine overheating prevention unit may set the preset dangerous temperature and the step of reducing the engine RPM to be multiple temperatures and steps, respectively, and set information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures.

In addition, the apparatus may further includes a compulsory engine stopping unit for compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

Preferably, the apparatus may further include a danger information informing unit for turning on a warning light or outputting an alarm sound, or displaying a message on a dashboard if the detected cooling water temperature is equal to or higher than the preset dangerous temperature.

In addition, the apparatus may further include a second engine overheating prevention unit for counting a predetermined time if the cooling fan is rotated at the preset minimum RPM due to the wiring short-circuit and failure of the fan clutch, and reducing the engine RPM regardless of the temperature of the cooling water to prevent the engine from being overheated if the counted predetermined time exceeds a preset dangerous time.

Preferably, the second engine overheating prevention unit 206 may set the preset dangerous time and the step of reducing the engine RPM to multiple times and steps, respectively, and set information on the engine RPM which it is desired to reduce according to each of the set multiple steps so as to reduce the engine RPM by the set RPM of a corresponding step matched whenever the counted predetermined time exceeds each of the set multiple dangerous times.

Advantageous Effect

The method and device for protecting an engine from a wiring short-circuit and failure of a fan clutch in accordance with an embodiment of the present invention as constructed above has the following advantages.

When a cooling fan is rotated at a minimum rpm due to the wiring short-circuit and failure of the fan clutch, the RPM of the engine can be stepwise reduced to protect the engine in a first step, and when the cooling water is severely overheated, the engine can be compulsorily stopped to protect the engine in a second step, thereby ensuring durability of the engine.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
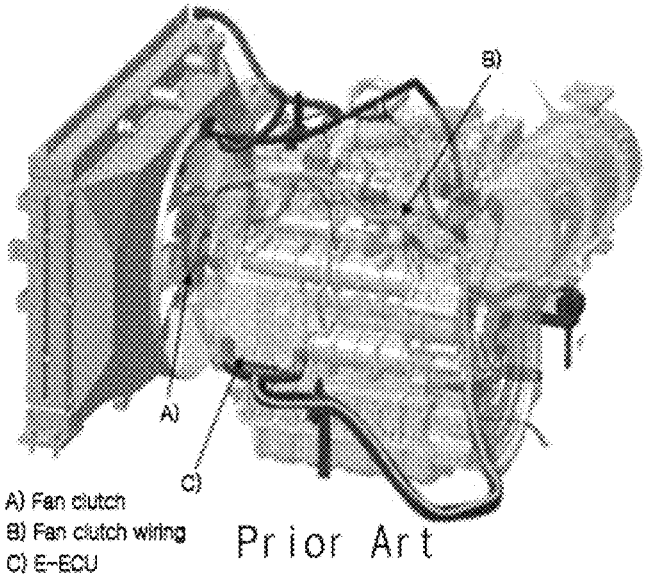
FIG. 1 is a perspective view showing a wiring structure of a fan clutch in accordance with the prior art.

201: cooling water temperature detection unit
202: temperature comparison unit
203: first engine overheating prevention unit
204: engine compulsorily-stopping unit
205: dangerous information alarming unit
206: second engine overheating prevention unit

DETAILED DESCRIPTION OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Hereinafter, use example of an apparatus for adjusting the height of armrests of a seat for a construction machine in accordance with an embodiment of the present invention will be described in detail with reference to the accompanying drawings.

In order to definitely describe the present invention, a portion having no relevant to the description will be omitted, and through the specification, like elements are designated by like reference numerals.

In the specification and the claims, when a portion includes an element, it is meant to include other elements, but not exclude the other elements unless otherwise specifically stated herein.

Figure 2:
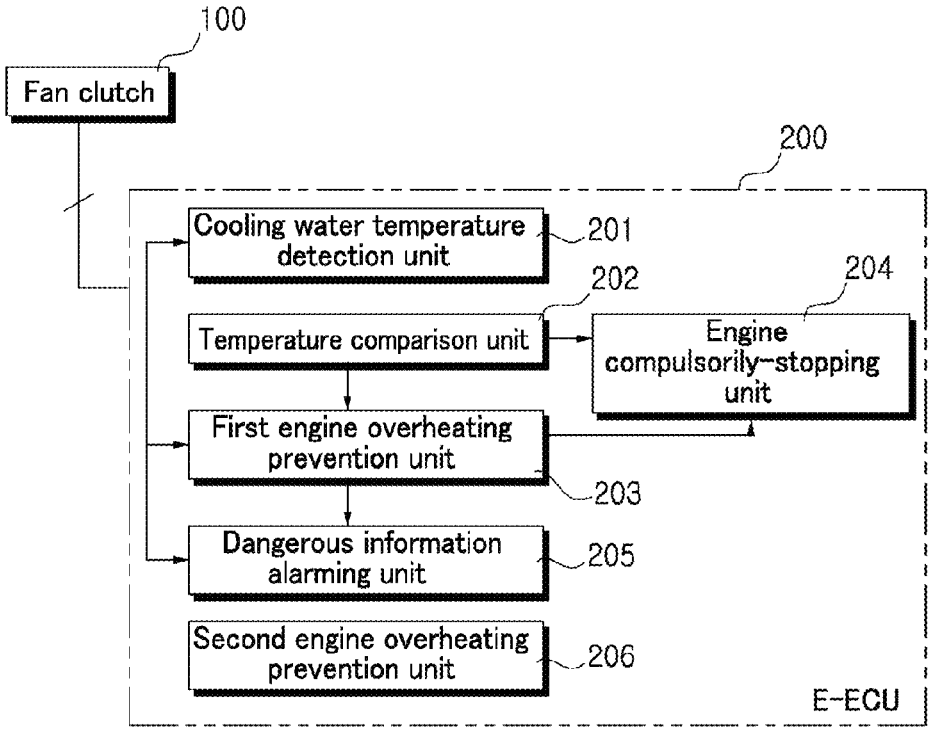
FIG. 2 is a block diagram showing the configuration of a device for protecting an engine from a wiring short-circuit and failure of a fan clutch in accordance with an embodiment of the present invention.

FIG. 2 is a block diagram showing the configuration of a device for protecting an engine from a wiring short-circuit and failure of a fan clutch in accordance with an embodiment of the present invention.

As shown in FIG. 2, the device of the present invention roughly includes a cooling water temperature detection unit 201, a temperature comparison unit 202, and a first engine overheating prevention unit 203. The present device further includes an engine compulsorily-stopping unit 204, a dangerous information alarming unit 205, and a second engine overheating prevention unit 206.

Herein, the cooling water temperature detection unit 201 serves to detect or measure the temperature of a cooling water if a cooling fan is rotated at a preset minimum RPM due to a wiring short-circuit and failure of a fan clutch. In this case, the detection or measurement of the temperature of a cooling water can be performed in connection with the time point when the cooling fan is rotated at the preset minimum RPM due to the wiring short-circuit and failure of the fan clutch.

The temperature comparison unit 202 compares the detected cooling water temperature with a preset dangerous temperature, and outputs different signals based on a result of the comparison. For example, the temperature comparison unit 202 outputs a first comparison signal, if the detected cooling water temperature is lower than the preset dangerous temperature. On the contrary, the temperature comparison unit 202 outputs a second comparison signal, if the detected cooling water temperature is equal to or higher than the preset dangerous temperature.

The first engine overheating prevention unit 203 defaults an engine RPM if the detected cooling water temperature is lower than the preset dangerous temperature as the result of the comparison of the temperature comparison unit 202, and reduces the engine RPM to prevent the engine from being overheated if the detected cooling water temperature is equal to or higher than the preset dangerous temperature. In this case, the first engine overheating prevention unit 203 may set the preset dangerous temperature and the step of reducing the engine RPM to be multiple temperatures and steps, respectively, and set information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures. For example, when the detected cooling water temperature becomes equal to or higher than a first dangerous temperature, the engine RPM may be reduced by 100 rpm, and when the detected cooling water temperature becomes equal to or higher than a second dangerous temperature, the engine RPM may be reduced by 200 rpm, etc.

The engine compulsorily-stopping unit 204 compulsorily stops the engine immediately without reducing the engine RPM if the detected cooling water temperature is equal to or higher than the preset dangerous temperature, or compulsorily stops the engine to protect the engine if the reduced engine RPM becomes equal to the preset minimum RPM after reducing the engine RPM.

The dangerous information alarming unit 205 turns on a warning light or outputting an alarm sound, or displays a message on a dashboard if the detected cooling water temperature is equal to or higher than the preset dangerous temperature.

The second engine overheating prevention unit 206 counts a predetermined time if the cooling fan is rotated at the preset minimum RPM due to the wiring short-circuit and failure of the fan clutch, and reduces the engine RPM regardless of the temperature of the cooling water to prevent the engine from being overheated if the counted predetermined time exceeds a preset dangerous time. In this case, the second engine overheating prevention unit 206 may set the preset dangerous time and the step of reducing the engine RPM to multiple times and steps, respectively, and set information on the engine RPM which it is desired to reduce according to each of the set multiple steps so as to reduce the engine RPM by the set RPM of a corresponding step matched whenever the counted predetermined time exceeds each of the set multiple dangerous times.

Hereinafter, the operation of a device for protecting an engine from a wiring short-circuit and failure of a fan clutch of FIG. 2 in accordance with an embodiment of the present invention will be described with reference to FIG. 3.

Figure 3:
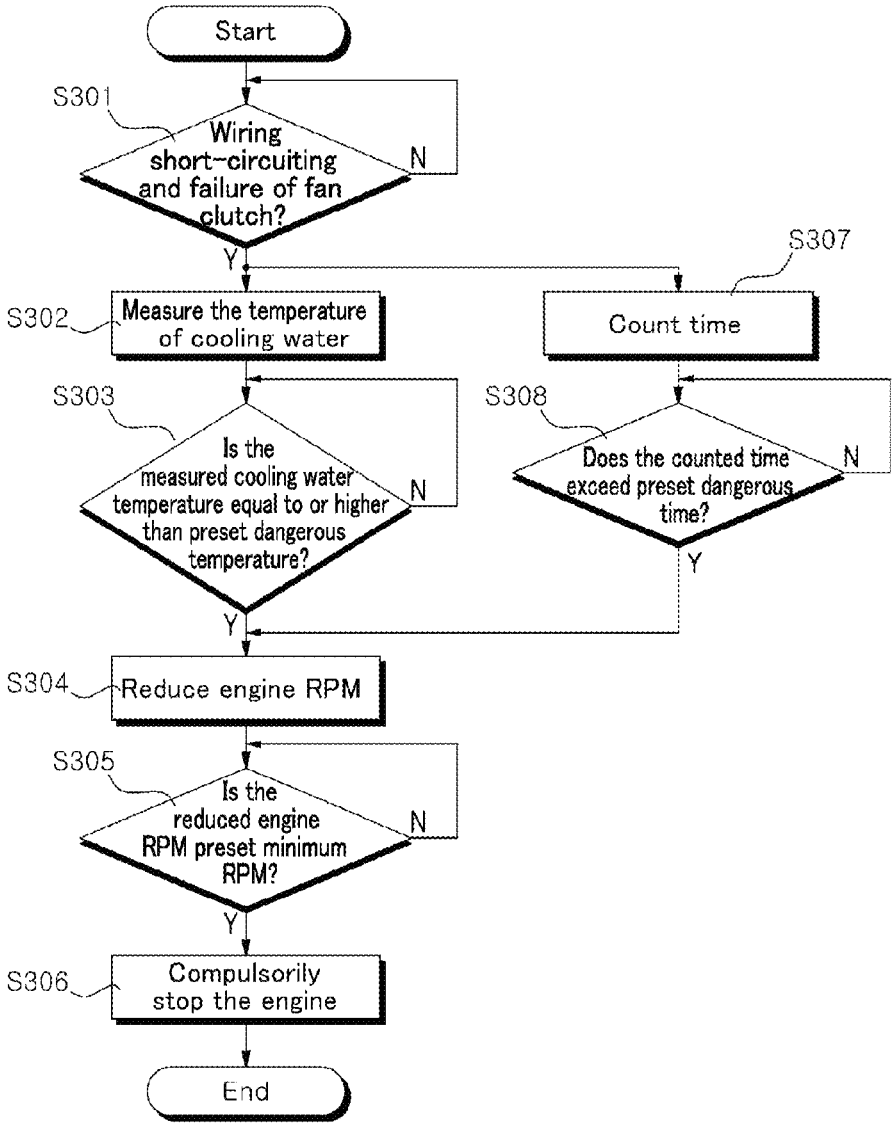
FIG. 3 is a flowchart showing the operation of a device for protecting an engine from a wiring short-circuit and failure of a fan clutch in accordance with an embodiment of the present invention.

As shown in FIG. 3, first, the cooling water temperature detection unit 201 detects or measures the temperature of a cooling water (S302) if a cooling fan is rotated at a preset minimum RPM due to a wiring short-circuit and failure of a fan clutch (S301).

In this case, the detection or measurement of the temperature of a cooling water can be performed in connection with the time point when the cooling fan is rotated at the preset minimum RPM due to the wiring short-circuit and failure of the fan clutch.

Subsequently, the temperature comparison unit 202 compares the cooling water temperature detected by the cooling water temperature detection unit 201 with a preset dangerous temperature, and outputs different signals based on a result of the comparison.

For example, the temperature comparison unit 202 outputs a first comparison signal, if the detected cooling water temperature is lower than the preset dangerous temperature, and outputs a second comparison signal, if the detected cooling water temperature is equal to or higher than the preset dangerous temperature.

Thereafter, the first engine overheating prevention unit 203 defaults an engine RPM if the detected cooling water temperature is lower than the preset dangerous temperature as the result of the comparison of the temperature comparison unit 202, and reduces the engine RPM to prevent the engine from being overheated if the detected cooling water temperature is equal to or higher than the preset dangerous temperature (S303 and S304).

In this case, the first engine overheating prevention unit 203 may set the preset dangerous temperature and the step of reducing the engine RPM to be multiple temperatures and steps, respectively, and set information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures. For example, when the detected cooling water temperature becomes equal to or higher than a first dangerous temperature, the engine RPM may be reduced by 100 rpm, and when the detected cooling water temperature becomes equal to or higher than a second dangerous temperature, the engine RPM may be reduced by 200 rpm, etc.

Meanwhile, the present invention enables the engine compulsorily-stopping unit 204 to compulsorily stop the engine immediately without reducing the engine RPM if the detected cooling water temperature is equal to or higher than the preset dangerous temperature, or to compulsorily stop the engine to protect the engine if the reduced engine RPM becomes equal to the preset minimum RPM after reducing the engine RPM (S305 and S306).

Further, the dangerous information alarming unit 205 turns on a warning light or outputting an alarm sound, or displays a message on a dashboard connected thereto to inform a user of a dangerous state if the detected cooling water temperature is equal to or higher than the preset dangerous temperature.

Additionally, the present invention enables the second engine overheating prevention unit 206 to count a predetermined time if the cooling fan is rotated at the preset minimum RPM due to the wiring short-circuit and failure of the fan clutch, and reduce the engine RPM regardless of the temperature of the cooling water to prevent the engine from being overheated if the counted predetermined time exceeds a preset dangerous time (S307 and S308).

In this case, the second engine overheating prevention unit 206 may set the preset dangerous time and the step of reducing the engine RPM to multiple times and steps, respectively, and set information on the engine RPM which it is desired to reduce according to each of the set multiple steps so as to reduce the engine RPM by the set RPM of a corresponding step matched whenever the counted predetermined time exceeds each of the set multiple dangerous times.

INDUSTRIAL APPLICABILITY

In accordance with the method and device for protecting an engine from a wiring short-circuit and failure of a fan clutch of the present invention as constructed above, when a cooling fan is rotated at a minimum rpm due to the wiring short-circuit and failure of a fan clutch, the RPM of the engine can be stepwise reduced depending on the temperature of a cooling water to protect the engine, and when the cooling water is severely overheated, the engine can be compulsorily stopped to protect the engine.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

The invention claimed is:

1. A method for protecting an engine from a wiring short-circuit and failure of a fan clutch in a system configured to drive a cooling fan at a preset minimum RPM when the wiring short-circuit and failure of the fan clutch occurs, the method comprising the steps of:

detecting a temperature of a cooling water if the cooling fan is rotated at the preset minimum RPM due to the wiring short-circuit and failure of the fan clutch;

comparing the detected cooling water temperature with a preset dangerous temperature; and defaulting an engine RPM if the detected cooling water temperature is lower than the preset dangerous temperature as a result of the comparison and reducing the engine RPM if the detected cooling water temperature is equal to or higher than the preset dangerous temperature.

2. The method according to claim 1, wherein the step of reducing the engine RPM comprises setting the preset dangerous temperature and the step of reducing the engine RPM to be multiple temperatures and steps, respectively, and setting information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures.

3. The method according to claim 1, further comprising compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

4. The method according to claim 1, further comprising turning on a warning light or outputting an alarm sound, or displaying a message on a dashboard if the detected cooling water temperature is equal to or higher than the preset dangerous temperature.

5. The method according to claim 1, further comprising counting a predetermined time if the cooling fan is rotated at the preset minimum RPM due to the wiring short-circuit and failure of the fan clutch, and reducing the engine RPM regardless of the temperature of the cooling water to prevent the engine from being overheated if the counted predetermined time exceeds a preset dangerous time.

6. The method according to claim 5, wherein the step of reducing the engine comprises setting the preset dangerous time and the step of reducing the engine RPM to multiple times and steps, respectively, and setting information on the engine RPM which it is desired to reduce according to each of the set multiple steps so as to reduce the engine RPM by the set RPM of a corresponding step matched whenever the counted predetermined time exceeds each of the set multiple dangerous times.

7. An apparatus for protecting an engine from a wiring short-circuit and failure of a fan clutch, the apparatus comprising:

a cooling water temperature detection unit for detecting a temperature of a cooling water if the cooling fan is rotated at the preset minimum RPM due to the wiring short-circuit and failure of the fan clutch;

a temperature comparison unit for comparing the detected cooling water temperature with a preset dangerous temperature; and a first engine overheating prevention unit for defaulting an engine RPM if the detected cooling water temperature is lower than the preset dangerous temperature as a result of the comparison and reducing the engine RPM to prevent the engine from being overheated if the detected cooling water temperature is equal to or higher than the preset dangerous temperature.

8. The apparatus according to claim 7, wherein the first engine overheating prevention unit sets the preset dangerous temperature and the step of reducing the engine RPM to be multiple temperatures and steps, respectively, and sets information on the engine RPM which it is desired to reduce according to each of the set multiple steps so as to reduce the engine RPM by the set RPM of a corresponding step matched whenever the detected cooling water temperature becomes equal to or higher than each of the set multiple dangerous temperatures.

9. The apparatus according to claim 7, further comprising a compulsory engine stopping unit for compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

10. The apparatus according to claim 7, further comprising a danger information informing unit for turning on a warning light or outputting an alarm sound, or displaying a message on a dashboard if the detected cooling water temperature is equal to or higher than the preset dangerous temperature.

11. The apparatus according to claim 7, further comprising a second engine overheating prevention unit for counting a predetermined time if the cooling fan is rotated at the preset minimum RPM due to the wiring short-circuit and failure of the fan clutch, and reducing the engine RPM regardless of the temperature of the cooling water to prevent the engine from being overheated if the counted predetermined time exceeds a preset dangerous time.

12. The apparatus according to claim 11, wherein the second engine overheating prevention unit sets the preset dangerous time and the step of reducing the engine RPM to multiple times and steps, respectively, and sets information on the engine RPM which it is desired to reduce according to each of the set multiple steps so as to reduce the engine RPM by the set RPM of a corresponding step matched whenever the counted predetermined time exceeds each of the set multiple dangerous times.

13. The method according to claim 2, further comprising compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

14. The apparatus according to claim 8, further comprising a compulsory engine stopping unit for compulsorily stopping the engine if the detected cooling water temperature is equal to or higher than the preset dangerous temperature, or compulsorily stopping the engine if the reduced engine RPM becomes equal to the preset minimum RPM after reducing the engine RPM.

* * * * *